US005512027A

United States Patent [19]

Chen

[11] Patent Number: 5,512,027

[45] Date of Patent: Apr. 30, 1996

[54] ROWING-TYPE EXERCISE DEVICE

[76] Inventor: Tsung-Yu Chen, No. 23-4, Ting-Liao, Sun-Ho Tsuen, Shiu-Shang Hsiang, Chiayi Hsien, Taiwan

[21] Appl. No.: 488,891

[22] Filed: Jun. 9, 1995

[51] Int. Cl.[6] ..... A63B 69/06; A63B 21/00

[52] U.S. Cl. ..... 482/72; 482/57; 482/95; 482/130

[58] Field of Search ..... D21/191, 195; 482/130, 72, 51, 95, 26, 57, 106, 148, 110, 133; 472/110; 280/1.182, 1.183, 1.192, 1.203, 1.204

[56] References Cited

U.S. PATENT DOCUMENTS

| | | | |
|---|---|---|---|
| 1,952,548 | 3/1934 | Hayes | 472/110 |
| 3,446,503 | 5/1969 | Lawton | 482/130 |
| 5,342,269 | 8/1994 | Huang et al. | 482/95 |
| 5,423,731 | 6/1995 | Chen | 482/72 |

FOREIGN PATENT DOCUMENTS

| | | | |
|---|---|---|---|
| 0498341 | 5/1930 | Germany | 482/130 |
| 2210191 | 9/1973 | Germany | 482/72 |
| 0496740 | 2/1937 | United Kingdom | 482/130 |

*Primary Examiner*—Jerome Donnolly
*Attorney, Agent, or Firm*—Knobbe, Martens, Olson & Bear

[57] ABSTRACT

An rowing-type exercise device includes a link unit having front and rear link members. The first end portions of the link members are connected pivotally and respectively to front and rear end portions of a base frame unit. An elongated frame body is disposed above the base frame unit and has opposed front and rear end portions to which the second end portions of the link members are connected pivotally and respectively to permit forward and rearward movement of the frame body relative to the base frame unit. A first connecting member has a first end portion connected pivotally to an intermediate portion of the rear link member between the first and second end portions of the rear link member and a second end portion. A second connecting member has a first end portion connected pivotally to the second end portion of the first connecting member and a second end portion connected to an intermediate portion of the frame body of the seat frame unit. A pair of operating levers are located respectively on two sides of the frame body. Each lever has a first end portion secured to an intermediate portion of the second connecting member and a second end portion which serves as a hand-gripping portion.

7 Claims, 5 Drawing Sheets

ROWING-TYPE EXERCISE DEVICE

BACKGROUND OF THE INVENTION

1. Field of the Invention

This invention relates to a rowing-type exercise device, more particularly to a rowing-type exercise device which makes use of the body weight of an exerciser as a load weight therefor and which is constructed to permit easy adjustment of the load weight of the rowing-type exercise device.

2. Description of the Related Art

Presently, currently available rowing-type exercise devices usually employ magnetic force, weights or resilient means as the load weight thereof. However, the conventional rowing-type exercise devices utilizing magnetic force as the load weight thereof are costly in view of their relatively complicated construction. The conventional rowing-type exercise devices utilizing weights as the load weight thereof are bulky and require a relatively large storage space. In addition, undesired noise is generated when such exercise devices are in use. Furthermore, the exercise effect offered by the conventional rowing-type exercise devices utilizing resilient means as the load weight thereof deteriorate due to fatigue of the resilient means after a long period of use.

SUMMARY OF THE INVENTION

Therefore, the main objective of the present invention is to provide a rowing-type exercise device which can overcome the aforementioned problems that are associated with the prior art.

According to the present invention, a rowing-type exercise device includes a base frame unit having opposed front and rear end portions. A link unit includes front and rear link members. Each of the link members has opposed first and second end portions. The first end portions of the link members are connected pivotally and respectively to the front and rear end portions of the base frame unit. A seat frame unit includes an elongated frame body which is disposed above the base frame unit and which has opposed front and rear end portions to which the second end portions of the link members are connected pivotally and respectively to permit forward and rearward movement of the frame body relative to the base frame unit. The seat frame unit further includes a foot support member mounted on the front end portion of the frame body and a seat member mounted slidably on an intermediate portion of the frame body. A connecting unit includes a first connecting member which has a first end portion connected pivotally to an intermediate portion of the rear link member between the first and second end portions of the rear link member and a second end portion, and a second connecting member which has a first end portion connected pivotally to the second end portion of the first connecting member and a second end portion connected to an intermediate portion of the frame body of the seat frame unit. An operating lever unit includes a pair of operating levers located respectively on two sides of the frame body. Each of the operating levers has a first end portion secured to an intermediate portion of the second connecting member and a second end portion which serves as a hand-gripping portion.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
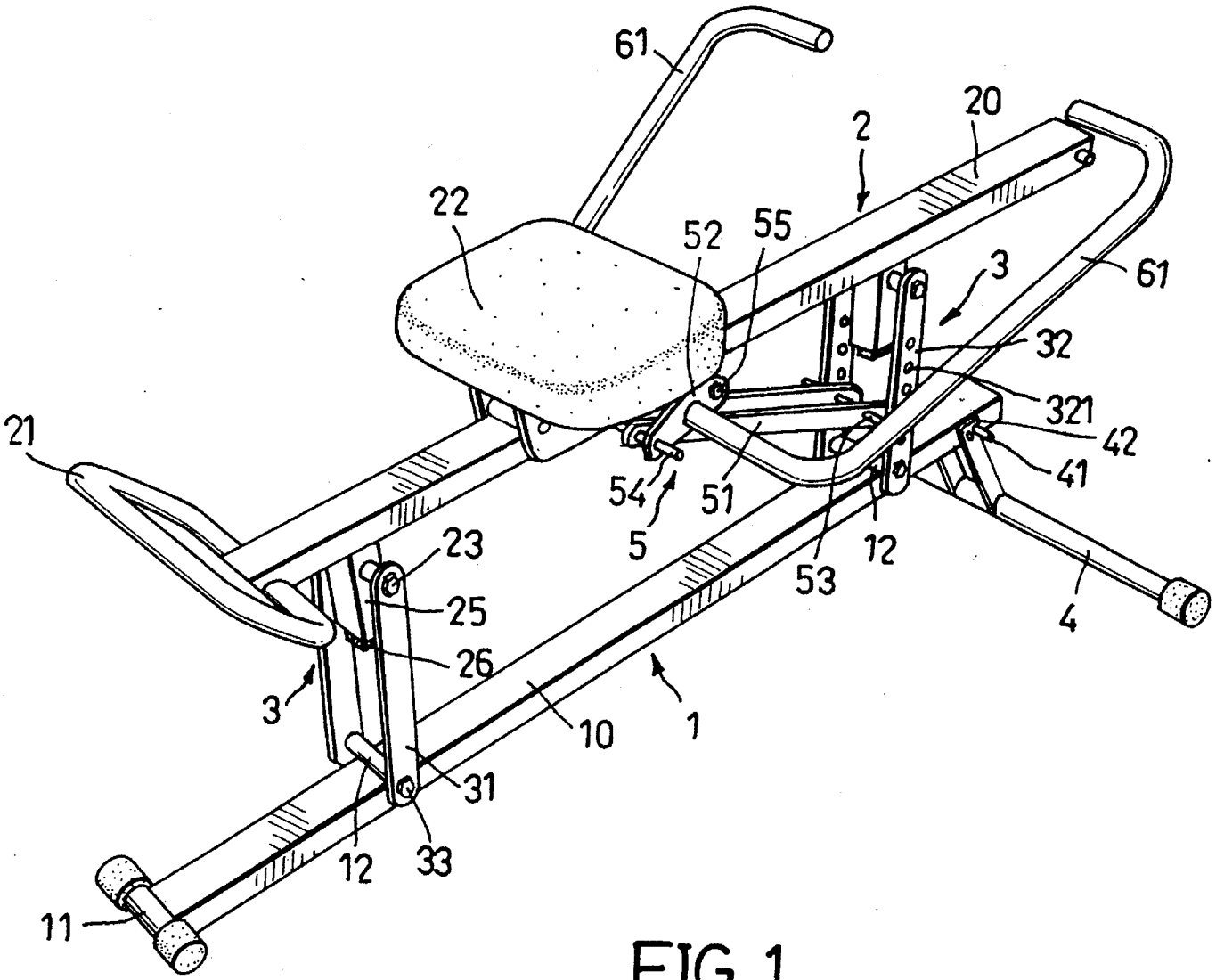
FIG. 1 is a perspective view showing a rowing-type exercise device according to a first embodiment of the present invention.
Figure 2:
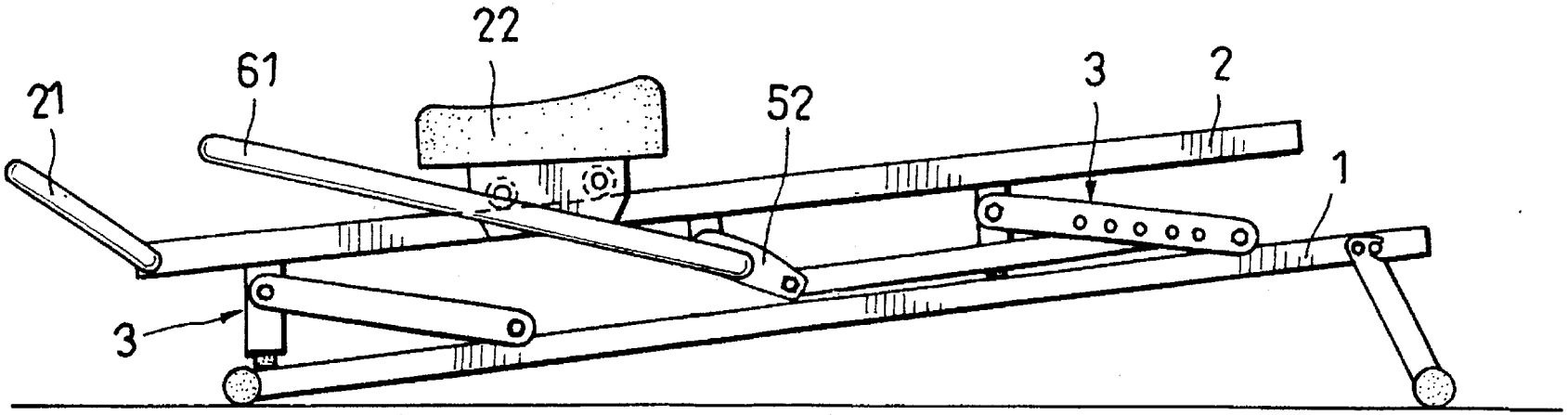
FIGS. 2 to 4 are side views illustrating the movement of the rowing-type exercise device according to the first embodiment of the present invention when an operating lever unit thereof is operated.

Referring to FIGS. 1 and 2, a rowing-type exercise device according to the present invention includes a base frame unit 1, a link unit 3, a seat frame unit 2, a connecting unit 5, a support leg frame 4 and an operating lever unit 6.

The base frame unit 1 includes an elongated frame 10 having opposed front and rear end portions, and a transverse frame 11 connected securely to the front end portion of the elongated frame 10. The elongated frame 10 further has a top surface on which two transverse pin-extending sleeves 12 are mounted respectively at the front and rear end portions. The rear end portion of the elongated frame 10 is formed with a pin-receiving hole 13 (see FIG. 5).

The link unit 3 includes front and rear link members 31 and 32. In the present embodiment, each of the link members 31,32 includes a pair of elongated parallel plates each having opposed first and second end portions. The first end portions of the plates of the front link member 31 are connected pivotally to the front end portion of the elongated frame 10 of the base frame unit 1 on two sides of the pin-extending sleeve 12 by means of a pivot pin 33 which extends through the sleeve 12 and the first end portions of the plates of the front link members 31. Similarly, the first end portions of the plates of the rear link member 32 are connected pivotally to the rear end portion of the elongated frame 10 of the base frame unit 1 in the same manner. Each of the plates of the rear link member 32 is formed with a row of through-holes 321 at an intermediate portion between the first and second end portions thereof.

The seat frame unit 2 includes an elongated frame body 20 which is disposed above the elongated frame 10 of the base frame unit 1 and which has opposed front and rear end portions. The frame body 20 is provided with front and rear mounting seats 25 that extend downwardly and respectively from a bottom of the front and rear end portions of the frame body 20. Each of the front and rear mounting seats 25 has a distal end provided with a resilient pad member 26 which contacts the elongated frame 10 of the base frame unit 1 when the frame body 20 rests on the elongated frame 10 of the base frame unit 1. The second end portions of the plates of the front link member 31 are connected pivotally to the front end portion of the frame body 20 on two sides of the front mounting seat 25 by means of a pivot pin 23 which extends through the second end portions of the plates of the front link member 31 and the front mounting seat 25. The second end portions of the plates of the rear link member 32 are connected pivotally to the rear end portion of the frame body 20 on two sides of the rear mounting seat 25 in the same manner so as to permit forward and rearward movement of the frame body 20 relative to the base frame unit 1. The seat frame unit 2 further includes a foot support member 21 mounted on the front end portion of the frame body 20 and a seat member 22 mounted slidably on an intermediate portion of the frame body 20 by means of rollers (shown in phantom lines in FIG. 2). Since the relationship among the seat member 22, the rollers and the frame body 20 is well known in the art, a detailed description thereof is thus omitted herein. An intermediate mounting seat 23 extends downwardly from the bottom of the frame body 20 between the front and rear mounting seats 25.

The connecting unit 5 includes first and second connecting members, 51 and 52. In the present embodiment, each of the connecting members 51,52 includes a pair of parallel plates, each having opposed first and second end portions. A pivot pin 53 is extendible into a selected one of the through-holes 321 for connecting adjustably the first end portions of the plates of the first connecting member 51 to the intermediate portion of the rear link member 32. The second end portions of the plates of the first connecting member 51 are connected pivotally to the first end portions of the plates of the second connecting member 52 by means of a pivot pin 54. The second end portions of the plates of the second connecting member 52 are connected pivotally to the intermediate mounting seat 23 of the frame body on two sides of the intermediate mounting seat 23 by means of a pivot pin 55.

The operating lever unit 6 includes a pair of operating levers 61. In the present embodiment, each of the operating levers 61 is a generally U-shaped lever and has a first end portion secured to an intermediate portion of the second connecting member 52 and a second end portion which serves as a hand-gripping portion.

In the present embodiment, the support leg frame 4 is a generally T-shaped frame and has a first end connected pivotally to the rear end portion of the elongated frame 10 of the base frame unit 1 adjacent to the pin-receiving hole 13 and a second end adapted to contact a floor surface (not shown) so as to support inclinedly the base frame unit 1 on the floor surface. The first end of the leg frame 4 is formed with a notch 42 which is alignable with the pin-receiving hole 13 in the elongated frame 10. A locking pin 41 extends removably through the notch 42 of the leg frame 4 and into the pin-receiving hole 13 in the elongated frame 10 so as to arrest pivoting movement of the leg frame 4 relative to the base frame unit 1.

Figure 3:
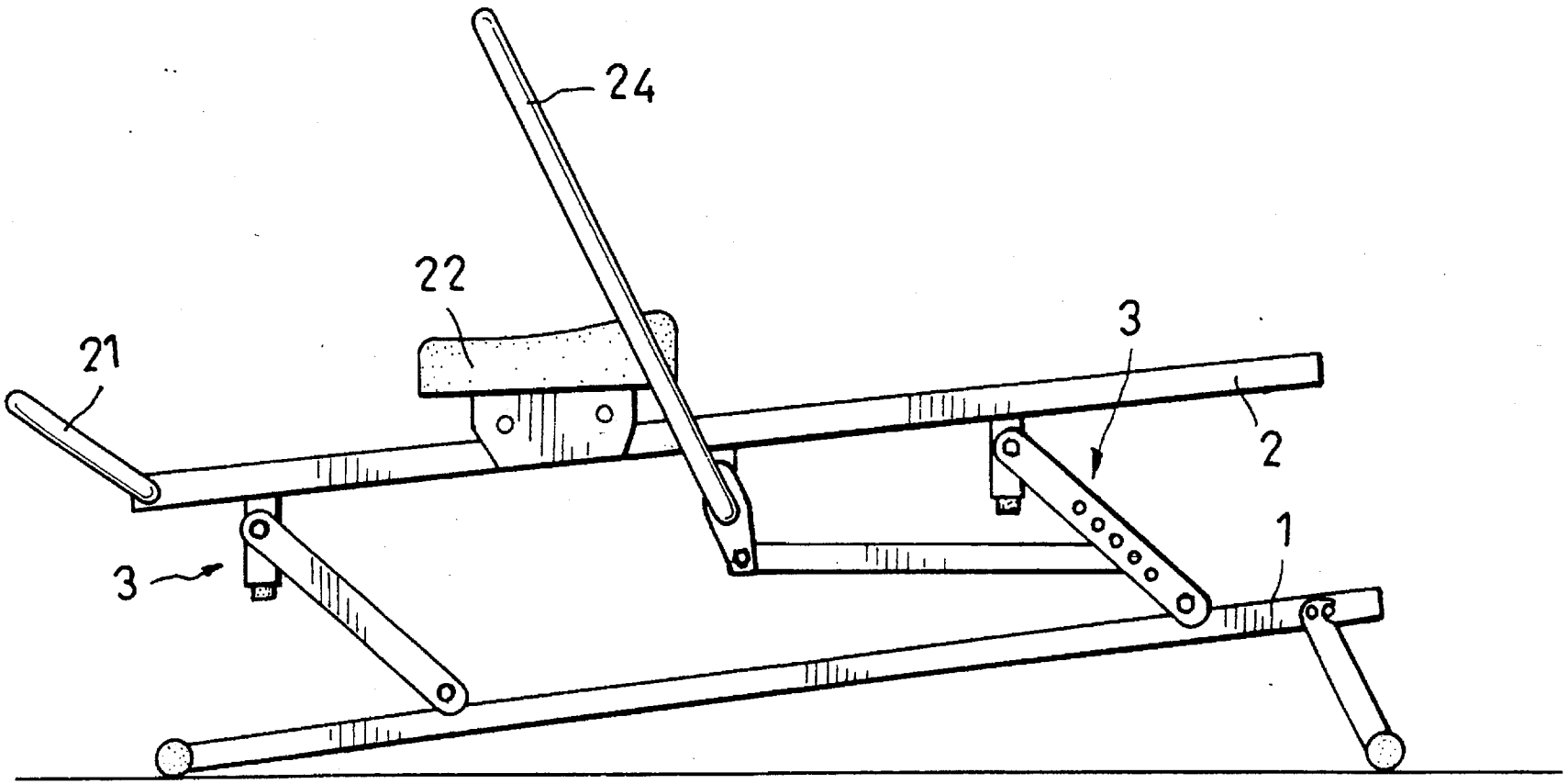
Figure 4:
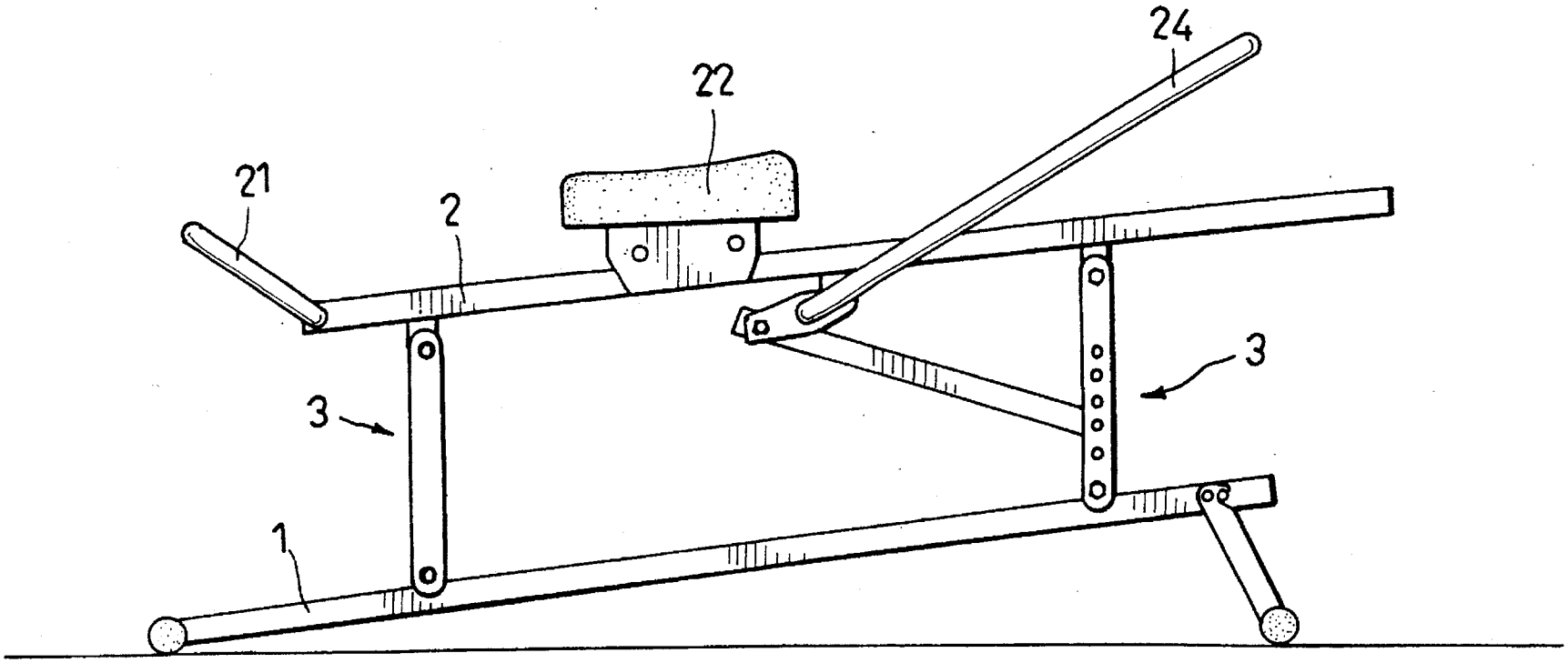

Referring now to FIGS. 2 to 4, when the rowing-type exercise device of the present invention is in use, the user (not shown) can sit on the seat member 22 such that his feet are supported on the support member 21. Then, the user can grasp the hand-gripping portions of the levers 61 and operate the levers 61 rearwardly. Operation of the levers 61 in this manner causes rearward movement of the seat frame unit 2 in view of the connection between the levers 61, the second connecting member 52 and the seat frame unit 2. Rearward movement of the seat frame unit 2 results in simultaneous upward movement of the same against the body weight of the user which serves as the load weight of the rowing-type exercise device. When the force applied on the levers 61 is removed, the seat frame unit 2 will move back to an original position, wherein the resilient pad members 26 contact the elongated frame 10 of the base frame unit 1, due to gravity. It is noted that the resilient pad members 26 can prevent the generation of noise when the seat frame unit 2 moves back to the original position while the rowing-type exercise device of the present invention is in use.

To adjust the load weight of the rowing-type exercise device of the present invention, it is only necessary to extend the pivot pin 53 into another one of the through-holes 321 of the rear link member 32. In the present embodiment, extension of the pivot pin 53 (see FIG. 1) into an upper one of the through-holes 321 will increase the load weight of the rowing-type exercise device. On the other hand, extension of the pivot pin 53 into a lower one of the through-holes 321 will reduce the load weight of the rowing-type exercise device.

Figure 5:
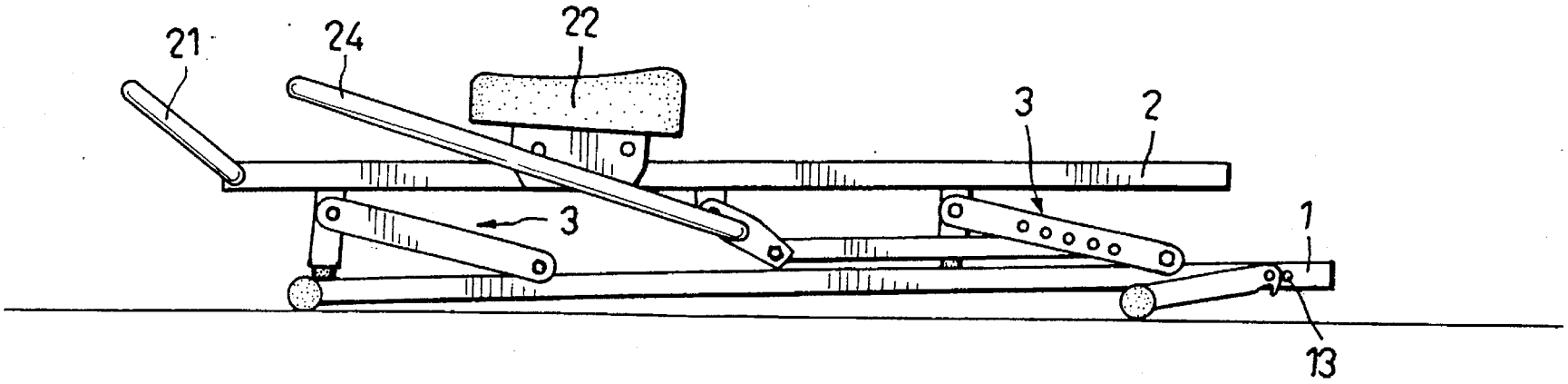
FIG. 5 is a side view showing the rowing-type exercise device according to the first embodiment of the present invention when the rowing-type exercise device is not in use.

Referring now to FIG. 5, when the rowing-type exercise device of the present invention is not in use, the locking pin 41 (see FIG. 1) can be removed from the pin-receiving hole 13 in the elongated frame 10 such that the support leg frame 4 can pivot forwardly to reduce the required storage space of the rowing-type exercise device of the present invention. In the present embodiment, the connecting means includes a sleeve member 70 sleeved fixedly on the first connecting arm 610 of the lever (61A) and a pivot pin 71 extending through the second end of the second connecting arm 611 and the sleeve member 70. The sleeve member 70 permits limited pivoting movement of the second connecting arm 611 relative to the first connecting arm 610 of the lever (61A).

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A rowing-type exercise device, comprising:

a base frame unit having opposed front and rear end portions;

a link unit including front and rear link members, each of said link members having opposed first and second end portions, said first end portions of said link members being connected pivotally and respectively to said front and rear end portions of said base frame unit;

a seat frame unit including an elongated frame body which is disposed above said base frame unit and which has opposed front and rear end portions to which said second end portions of said link members are connected pivotally and respectively to permit forward and rearward movement of said frame body relative to said base frame unit, said seat frame unit further including a foot support member mounted on said front end portion of said frame body and a seat member mounted slidably on an intermediate portion of said frame body;

a connecting unit including a first connecting member which has a first end portion connected pivotally to an intermediate portion of said rear link member between said first and second end portions of said rear link member and a second end portion, and a second connecting member which has a first end portion connected pivotally to said second end portion of said first connecting member and a second end portion connected to an intermediate portion of said frame body of said seat frame unit; and an operating lever unit including a pair of operating levers located respectively on two sides of said frame body, each of said operating levers having a first end portion secured to an intermediate portion of said second connecting member and a second end portion which serves as a hand-gripping portion.

2. A rowing-type exercise device as claimed in claim 1, wherein said rear link member is formed with a row of through-holes between said first and second end portions thereof and has a pivot pin extendible into a selected one of said through-holes for connecting adjustably said first end portion of said first connecting member to said intermediate portion of said rear link member.

3. A rowing-type exercise device as claimed in claim 1, further comprising a support leg frame having a first end connected to said rear end portion of said base frame unit and a second end adapted to contact a floor surface so as to support inclinedly said base frame unit on said floor surface.

4. A rowing-type exercise device as claimed in claim 3, wherein said support leg frame is connected pivotally to said rear end portion of said base frame unit at said first end thereof, said rear end portion of said base frame unit being formed with a pin-receiving hole, said first end of said leg frame being formed with a notch which is alignable with said pin-receiving hole in said base frame unit, said base frame unit including a locking pin which extends removably through said notch of said leg frame and into said pin-receiving hole of said base frame unit so as to arrest pivoting movement of said leg frame relative to said base frame unit.

5. A rowing-type exercise device as claimed in claim 1, wherein said frame body is provided with front and rear mounting seats which extend downwardly and respectively from said front and rear end portions of said frame body, said second end portions of said front and rear link members being connected pivotally and respectively to said front and rear mounting seats.

6. A rowing-type exercise device as claimed in claim 5, wherein each of said front and rear mounting seats has a distal end provided with a resilient pad member which contacts said base frame unit when said frame body of said seat frame unit rests on said base frame unit.

7. A rowing-type exercise device as claimed in claim 1, wherein each of said operating levers is a generally U-shaped lever.

* * * * *